US007990401B2

(12) United States Patent
Li et al.

(10) Patent No.: US 7,990,401 B2
(45) Date of Patent: Aug. 2, 2011

(54) LIQUID CRYSTAL DRIVING SYSTEM AND METHOD FOR DRIVING LIQUID CRYSTAL DISPLAY

(75) Inventors: Huan-Hsin Li, Miao Li Hsien (TW); Yao-Jen Hsieh, Ping Tung Hsien (TW); Kuei-Hsueh Chen, Nan-Tao Hsien (TW); Fang-Yu Su, Yu Lin Hsien (TW)

(73) Assignee: Au Optronics Corp., Hsinchu (TW)

( * ) Notice: Subject to any disclaimer, the term of this patent is extended or adjusted under 35 U.S.C. 154(b) by 1384 days.

(21) Appl. No.: 11/505,852

(22) Filed: Aug. 18, 2006

(65) Prior Publication Data

US 2007/0052643 A1 Mar. 8, 2007

(30) Foreign Application Priority Data

Sep. 2, 2005 (TW) ..... 94130160 A

(51) Int. Cl.
*G09G 3/36* (2006.01)
*G09G 5/10* (2006.01)

(52) U.S. Cl. ..... 345/690; 345/89

(58) Field of Classification Search ..... 345/204, 345/690, 692, 87–104
See application file for complete search history.

(56) References Cited

U.S. PATENT DOCUMENTS

| | | | | |
|---|---|---|---|---|
| 7,382,349 | B1 * | 6/2008 | Kuhns | 345/102 |
| 2003/0013752 | A1 | 1/2003 | Breimer et al. | |
| 2004/0130559 | A1 * | 7/2004 | Lee et al. | 345/690 |
| 2004/0196274 | A1 * | 10/2004 | Song et al. | 345/204 |
| 2005/0237316 | A1 * | 10/2005 | Huang et al. | 345/204 |
| 2005/0253785 | A1 * | 11/2005 | Miyasaka et al. | 345/63 |
| 2005/0253833 | A1 * | 11/2005 | Teshirogi et al. | 345/204 |
| 2005/0275646 | A1 * | 12/2005 | Pai et al. | 345/204 |
| 2006/0103682 | A1 * | 5/2006 | Kunimori et al. | 345/690 |
| 2006/0152535 | A1 * | 7/2006 | Huang et al. | 345/690 |
| 2006/0202945 | A1 * | 9/2006 | Feng | 345/102 |
| 2007/0024558 | A1 * | 2/2007 | Oura | 345/89 |
| 2007/0052643 | A1 * | 3/2007 | Li et al. | 345/89 |

FOREIGN PATENT DOCUMENTS

| | | | |
|---|---|---|---|
| EP | 1538598 | A2 | 6/2005 |
| TW | 571280 | B | 1/2004 |
| TW | 227007 | B | 1/2005 |

* cited by examiner

*Primary Examiner* — Alexander S. Beck
(74) *Attorney, Agent, or Firm* — Birch, Stewart, Kolasch & Birch, LLP

(57) ABSTRACT

A method for driving a liquid crystal display includes: a) receiving a video signal from a first group of gray scales values; b) comparing a current frame of the video signal with a previous frame to determine whether the current frame is in a static state or in a dynamic state; c) when the current frame is determined to be in the static state, converting the video signal to a driving signal; d) when the current frame is determined to be in the dynamic state, calculating a overdrive signal. The value of the driving signal is selected from a second group of gray scale values having at least one decimal point gray scale and having the same number of gray scale values as that of the first group of gray scale values. The value of the overdrive signal is selected from the first group of gray scale values.

18 Claims, 4 Drawing Sheets

| Final Level \ Initial Level | 0 | 16 | 32 | 48 | 64 | 80 | 96 | 112 | 128 | 144 | 160 | 176 | 192 | 208 | 224 | 240 | 255 |
|---|---|---|---|---|---|---|---|---|---|---|---|---|---|---|---|---|---|
| 0 | | | | | | | | | | | | | | | | | |
| 16 | | | | | | | | | | | | | | | | | |
| 32 | | | | | | | | | | | | | | | | | |
| 48 | | | | | | | | | | | | | | | | | |
| 64 | | | | | | | | | | | | | | | | | |
| 80 | | | | 192 | | | | | | | | | | | | | |
| 96 | | | | | | | | | | | | | | | | | |
| 112 | | | | | | | | | | | | | | | | | |
| 128 | | | | | | | | | | | | | | | | | |
| 144 | | | | A | C | | | | | | | | | | | | |
| 160 | | | | B | D | | | | | | | | | | | | |
| 176 | | | | | | | | | | | | | | | | | |
| 192 | | | | | | | | | | | | | | | | | |
| 208 | | | | | | | | | | | | | | | | | |
| 224 | | | | | | 255 | | | | | | | | | | | |
| 240 | | | | | | | | | | | | | | | | | |
| 255 | 255 | | | | | | | | | | | | | | | | 255 |

overdrive signal look-up table

LIQUID CRYSTAL DRIVING SYSTEM AND METHOD FOR DRIVING LIQUID CRYSTAL DISPLAY

BACKGROUND OF THE INVENTION (1) Field of the Invention

The present invention relates to a liquid crystal display and in particular to a liquid crystal driving system and a method for driving a liquid crystal display.

(2) Description of the Prior Art

The main advantages of liquid crystal displays are easy to achieve high resolutions and slim sizes. Therefore, liquid crystal displays are widely used in notebook computers. And because of constant developments in large-sized displays, liquid crystal displays also become the main-stream monitors for desktop computers. Moreover, liquid crystal display televisions are popular commodities in the television market.

FIG. 1 is a basic diagram of a liquid crystal display 10. A liquid crystal panel 12 comprises a plurality of pixel units 121. By providing a specific electrical voltage to the liquid crystal molecules of each pixel unit 121, the spinning angle of the liquid crystal molecules can be changed. With a backlight 14 underneath the liquid crystal panel 12, each pixel unit 121 in the liquid crystal panel 12 has a different penetration ratio to light. The plurality of pixel units 121 forms an array providing visual frames for a user seeing. In more details, each pixel unit 121 comprises three sub-pixels 121R, 121G and 121B. Each sub-pixel (121R, 121G or 121B) handles one color element (red or green or blue) within a pixel unit 121.

One of the technical bottlenecks in liquid crystal display technology is related to the physical property of liquid crystal molecules. When the particular electrical voltage as described above is applied to liquid crystal molecules, the liquid crystal molecules require a period of time for reacting and turning its initial angle to a different angle (with the resulting angle related to the particular electrical voltage input applied). When displaying a moving image, the response time of liquid crystal molecules can not catch up the screen refresh rate, thus resulting in delay and poor display quality. Therefore, shortening the response time of liquid crystal molecules is an important issue in liquid crystal display technology.

Liquid Crystal Display overdrive (LCD overdrive) is a method to shorten the display lag time. The method provides a higher (or lower) electrical voltage to liquid crystal molecules and forces the liquid crystal molecules to turn to the required angle within a prearranged period of time. The following FIG. 2 explains the liquid crystal display overdrive technology. In FIG. 2, the vertical axis represents the spinning angle of liquid crystal molecules, and the horizontal axis represents time. When applying a control voltage $V_{CL}$ to a pixel unit, the liquid crystal molecules require a period of time t2 for changing from the angle $\theta_0$ to the angle $\theta_1$ corresponding to the control voltage $V_{CL}$. The liquid crystal display overdrive technology is to apply an overdrive control voltage $V_{OD}$ ($V_{OD}$ is the control voltage of angle $\theta_2$) to a pixel unit in advance, and thus the time shortens to t1 for turning the liquid crystal molecules to the angle $\theta_1$, thus resulting in reducing the response time of liquid crystal molecules.

Referring to FIG. 3, FIG. 3 shows a traditional liquid crystal driving system with an overdrive function. A liquid crystal driving system 20 receives a video signal 21. The video signal 21 could be from either DVD or VCD players, computer video outputs, or other signal sources. The video signal 21 is a gray scale signal, and typically able to display 256 different gray scales within one sub-pixel. When processing various kinds of input signals, integers (E.g. 0, 1, 2, 3 . . . 254, and 255) are usually used to represent each gray scales. However, in implementation, binary numbers are used instead of integer numbers.

The liquid crystal driving system 20 can finally produce a control voltage $V_{CL}$ and an overdrive voltage $V_{OD}$ to drive the liquid crystal display panel (FIG. 1 mark 12). The control voltage $V_{CL}$ is generated according to a driving signal 21'. The overdrive voltage $V_{OD}$ is generated according to an overdrive signal 23. The liquid crystal driving system 20 comprises an overdrive unit 22, generating the driving signal 21' according to the video signal 21 and generating the overdrive signal 23 according to the video signal 21 and an overdrive signal look-up table (FIG. 4). The overdrive signal look-up table is built within the overdrive unit 22. The Driving signal 21' and overdrive signal 23 are digital gray scale signals. The liquid crystal driving system 20 further comprises a selector 24, which receives either a logical zero or a logical one signal from the overdrive unit 22. The selector 24 can selectively output either the driving signal 21' or the overdrive signal 23. Thereafter, a driver IC 35 generates the control voltage $V_{CL}$ and the overdrive voltage $V_{OD}$ after processing the signals through one or a plurality of backend components 33. The backend component 33 comprises video controllers and other electronic components.

The gray scale value of driving signal 21' in sub-pixels of each frame roughly equals the gray scale value of video signal 21. The gray scale value of overdrive signal 23 in sub-pixels of each frame can be obtained after comparing and processing the current frame with the previous frame.

The processing method of the overdrive signal 23 is as follows. When an image is displayed, each sub-pixel is either in a "dynamic state" or in a "static state" between each frame. The "dynamic state" means that a sub-pixel displays different gray scale values in the current frame and the previous frame; and the "static state" means a sub-pixel remains in the same gray scale value from previous frame.

So, the liquid crystal driving system 20 with an overdrive function relies on the video signal 21 for determining each pixel in either the "dynamic state" or the "static state" between frames. In the "static state", because the gray scale value remains the same, the overdrive function does not have to work. The driving signal 21' is directly generated according to the video signal 21 through the overdrive unit 22. In the "dynamic state", the overdrive unit 22 relies on the change of the gray scale values between frames for determining the value of the overdrive signal 23.

For example, the value of the overdrive signal 23 typically is selected from one of the 256 gray scale colors of the video signal 21. Therefore, the value of the overdrive signal 23 is never out of the bound from the gray scale values of the video signal 21. For condition that both have 256 gray scale values in common, the gray scale value of the overdrive signal 23 is also selected from integers 0 to 255.

To answer the question that which gray scale value of the video signal 21 will be selected to be the value of the overdrive signal 23. The FIG. 4 and the following will explain.

FIG. 4 shows an embodiment of the overdrive signal look-up table. The value of the overdrive signal 23 in the liquid crystal driving system 20 is determined by this table.

FIG. 4 shows that each sub-pixel can display up to 256 different gray scale colors, and the gray scale 0 means white color, and the gray scale 255 means black color (Or in reverse). The initial level in FIG. 4 represents the gray scale value of the sub-pixel in previous frame, and the final level in FIG. 4 represents the gray scale value of the sub-pixel in current frame. The current frame is displayed immediately after the previous frame.

For example, from the video signal 21, if the gray scale value of the sub-pixel is 48 in the first frame, and then when it refreshes to the second frame, the sub-pixel gray scale value is 80, the value of the overdrive signal 23 can be determined as the gray scale value 192 by referring to the overdrive signal look-up table.

Referring to following table, the table shows the process from the first frame to the forth frame. The gray scale values of the overdrive signal 23 and the driving signal 21' are shown for the liquid crystal driving system 20.

| | Video signal 21 | Overdrive signal 23 | Driving signal 21' |
|---|---|---|---|
| 1st Fame | Gray scale 48 | — | Gray scale 48 |
| 2nd Frame | Gray scale 80 | Gray scale 192 | — |
| 3rd Frame | Gray scale 80 | — | Gray scale 80 |
| 4th Frame | Gray scale 224 | Gray scale 255 | — |

From the table above, it is not necessary for each sub-pixel to apply the overdrive function during refreshing frames. For example, the sub-pixel remains in its gray scale 80 from the second frame to the third frame. This is also known as the "static state". It is not necessary to apply the overdrive signal 23 and the overdrive control voltage $V_{OD}$. It only needs to provide the control voltage $V_{CL}$ matching the voltage required for the gray scale 80 for keeping the same spinning angle and maintaining brightness of liquid crystal molecules in the particular sub-pixel.

When the fist frame refreshes to the second frame and the third frame refreshes to the forth frame, the overdrive function is applied. This is known as the "dynamic state". For example, when the first frame refreshes to the second frame, the system provides an overdrive control voltage $V_{OD}$ (matching the voltage for the gray scale 192) to the particular sub-pixel. And liquid crystal molecules can reach the required spinning angle within the desired time.

However, the known liquid crystal driving system 20 is unable to provide the overdrive function when the gray scale is either in the highest gray scale value or in the lowest gray scale value (white screen or black screen).

Because the gray scale values of the overdrive signal 23 are equal to the gray scale values of the video signal 21. When displaying the highest gray scale (E.g. gray scale 255), it is unable to provide a higher gray scale signal to be the value of the overdrive signal 23. For the same reason, when displaying the lowest gray scale (E.g. gray scale 0), it is also unable to provide a lower gray scale signal for applying the overdrive action.

Referring to FIG. 3 and FIG. 4. When under the "dynamic state", the video signal 21 requests to display the gray scale 255 in a sub-pixel. The liquid crystal driving system 20 can only get the same highest gray scale reading 255 from the overdrive signal 23. This reading is not higher than the request of the video signal 21. Therefore, such an overdrive function is unable to accelerate liquid crystal molecules spinning to the desired angle.

Thus, how to improve the problem as discussed above and to provide a more refined overdrive function in a liquid crystal driving system is the primary goal of this invention.

SUMMARY OF THE INVENTION

One objective of the present invention is to improve the drawback of prior art and push forward the development of the liquid crystal display technology.

Another objective of the present invention is to provide a liquid crystal driving system with a new overdrive function, which is able to perform when the gray scale is either in the highest gray scale value or in the lowest gray scale value.

The present invention provides a liquid crystal driving system and a driving method for liquid crystal display, both capable of performing the new overdrive function.

The liquid crystal driving system according to the present invention receives a video signal. The value of the video signal is selected from a first group of gray scale values having a plurality of integer gray scale values. The liquid crystal driving system comprises an overdrive unit, a gray scale converter and a look-up table unit.

The overdrive unit compares a current frame of the video signal with a previous frame to determine in a dynamic state or in a static state. Moreover, the overdrive unit calculates an overdrive signal for the dynamic state. The value of the overdrive signal is selected from the first group of gray scale values. In addition, the gray scale converter is electrically connected to the overdrive unit, and firstly receives the video signal from the overdrive unit and then converts to a driving signal. The value of the driving signal is selected from a second group of gray scale values having at lease one decimal point gray scale and having the same number of gray scale values as that of the first group of gray scale values.

The look-up table comprises a gamma correction table. The driving signal looks up the gamma correction table for generating a corrective gray scale value of the driving signal in the static state. Otherwise, the overdrive signal looks up the gamma correction table for generating a corrective gray scale value of the overdrive signal in the dynamic state. Moreover, the highest gray scale value in the second group of gray scale values is smaller than the highest gray scale value in the first group of gray scale values; or/and, the lowest gray scale value in the second group of gray scale values is larger than lowest gray scale value in the first group of gray scale values.

These and other objectives of the present invention will no doubt become obvious to those of ordinary skill in the art after reading the following detailed description of the preferred embodiment which is illustrated in the various figures and drawings.

BRIEF DESCRIPTION OF THE DRAWINGS

From following detail description with illustration diagrams, the advantages of present invention can easily be comprehended, wherein the FIG. 1 is a basic diagram of a liquid crystal display.

DESCRIPTION OF THE PREFERRED EMBODIMENT

Figure 5:
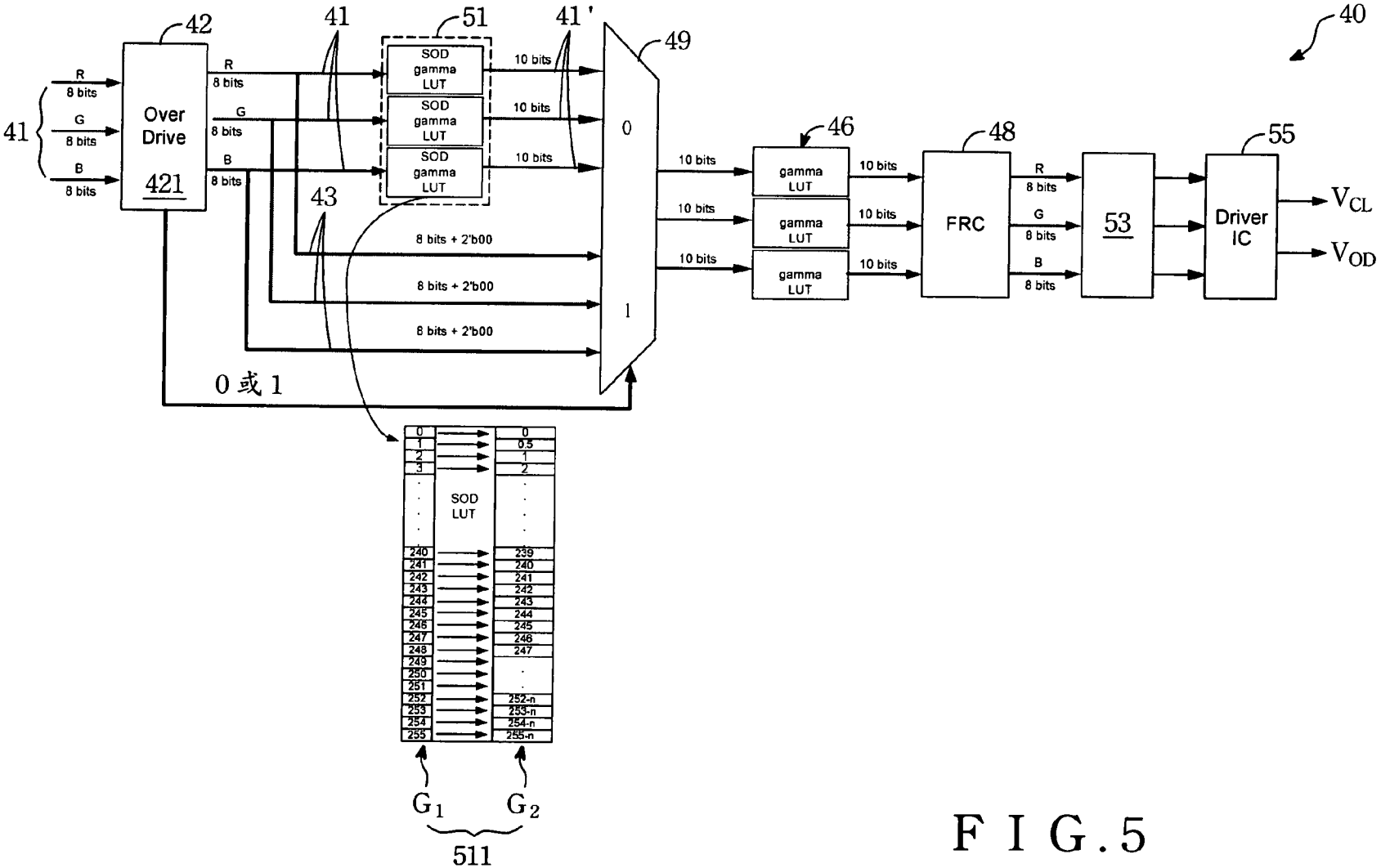
FIG. 5 illustrates a schematic illustration showing a liquid crystal driving system according to an embodiment of the present invention.

Please refer to FIG. 5. FIG. 5 illustrates a schematic illustration showing a liquid crystal driving system according to an embodiment of the present invention. The liquid crystal driving system 40 comprises an overdrive unit 42, a gray scale converter 51, a look-up table unit 46, a frame rate control unit 48, one or a plurality of backend components 53 and a driver integrated circuit 55.

As the embodiment shown in FIG. 5, a video signal 41, which is input to the liquid crystal driving system 40, is a gray scale signal. The value of the video signal 41 is selected from a first group of gray scale values G1 having a plurality of integer gray scale values. The plurality of integer gray scale values of the first group of the gray scale values G1 is selected from value 0, 1, 2, 3 . . . and up to 255, for this embodiment. The number, or amount, of the integer gray scale values of the first group of gray scale values G1 is 256. In implementation, each integer gray scale value can be an 8 bit digital signal.

The overdrive unit 42 first receives the video signal 41 and then compares a current frame of the video signal 41 with a previous frame to determine in a dynamic state or in a static state. In implementation, the overdrive unit 42 comprises a memory 421 for temporarily storing the previous frame. At the moment the current frame being sent to the overdrive unit 42, the overdrive unit 42 proceeds to compare the two frames.

The overdrive unit 42 relies on the previously mentioned comparison result to generate a logic one signal or a logic zero signal, and uses the logic one signal or the logical zero signal to determine whether applying an overdrive function, of the present invention, to the current frame. For example, when the comparison result shows a sub-pixel is in the same state of gray scale (which means in the static state) from comparing the previous frame with the current frame, then the logic zero signal will be transmitted to the selector 49. Therefore, the liquid crystal driving system 40 generates a control voltage $V_{CL}$. Alternatively, if the comparison result shows a sub-pixel is in a different state of gray scale (which means in the dynamic state) from comparing the previous frame with the current frame, then the logic one signal will be transmitted to the selector 49. And the liquid crystal driving system 40 generates an overdrive voltage $V_{OD}$.

From the video signal 41, the overdrive unit 42 can calculate and generate an overdrive signal 43. In the dynamic state, the overdrive signal 43 is used for generating the overdrive voltage $V_{OD}$. The overdrive signal 43 is also a gray scale signal. The gray scale values of the overdrive signal 43 are selected from the first group of gray scale values G1. For example, in the embodiment of FIG. 5, the gray scale values of the overdrive signal 43 can be 0, 1, 2, 3 . . . and up to 254.

Figure 1:
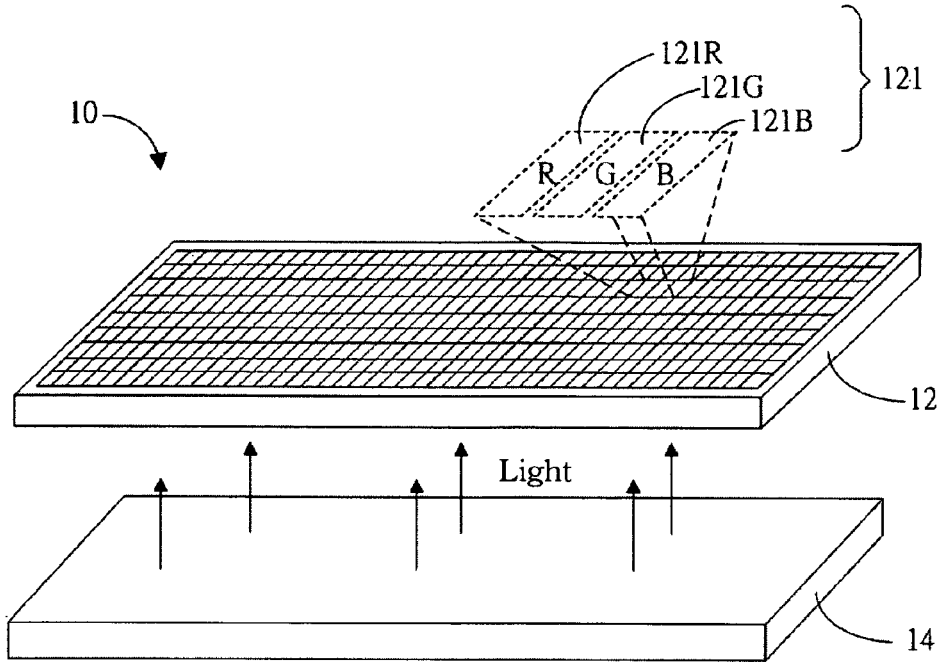
F I G . 1 (Prior Art)
Figure 2:
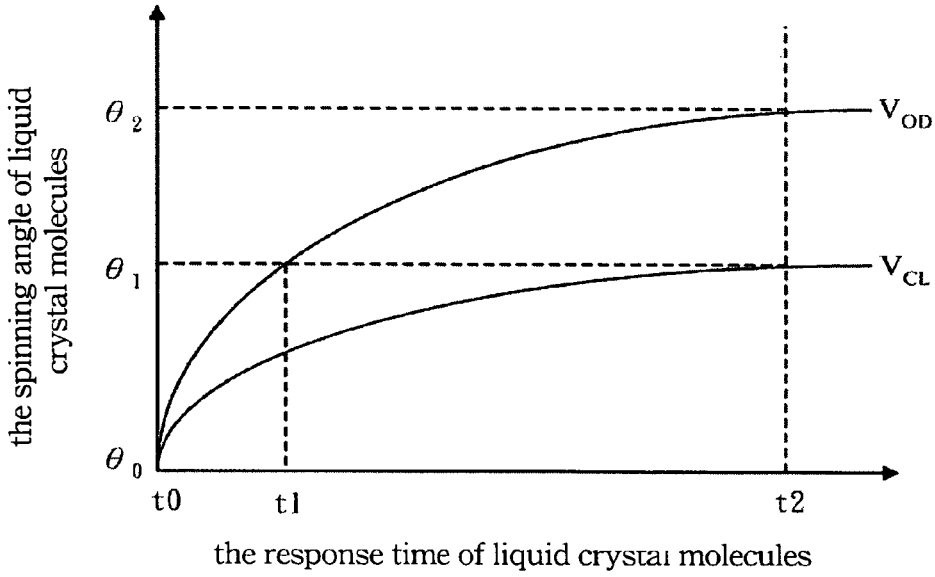
F I G . 2 A (Prior Art)
FIG. 2 is a relational chart of the spinning angle of liquid crystal molecules verses response time.
Figures 3, 4:
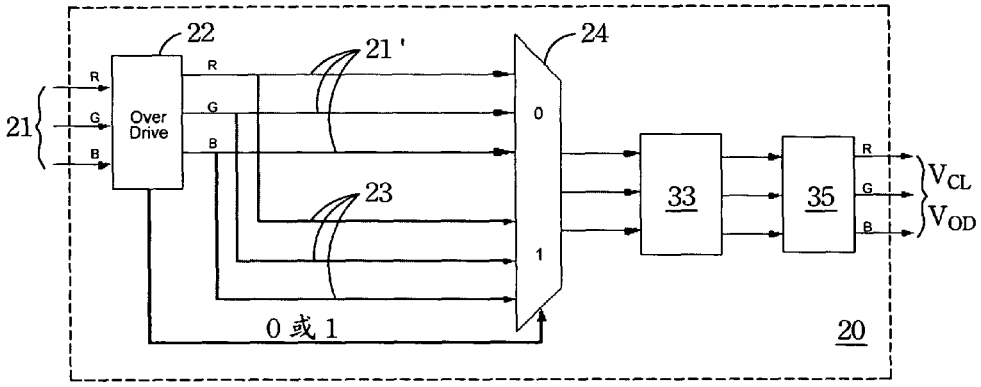
F I G . 3 (Prior Art)
FIG. 3 is a traditional liquid crystal driving system with an overdrive function.
FIG. 4 illustrates an embodiment of an overdrive signal look-up table.

The overdrive signal 43 is generated by referring to a look-up table, for example, by referring to an overdrive signal look-up table. The overdrive signal look-up table, as shown in FIG. 4, is built within the overdrive unit 42 of FIG. 5. The gray scale values of the previous frame are stored in the memory 421, which are used as searching input for inquiries of row from the look-up table (shown in FIG. 4). And, the gray scale values of the video signal 41 of the current frame are also used as searching input for inquiries of column from the look-up table. Then, the values of the overdrive signal 43 can be obtained by mapping the inquiries of row and the inquiries of column on the overdrive signal look-up table.

The gray scale converter 51 electrically connects to the overdrive unit 42, for receiving the video signal 41, and converts the video signal 41 to a driving signal 41'. The driving signal 41' is also a gray scale signal. Each gray scale value of the driving signal 41' is selected from a second group of gray scale values G2. In comparison of the two groups, the first group of gray scale values G1 has only integer gray scale values, and the second group of gray scale values G2 has at lease one decimal point gray scale (for example, 0.5). And the second group of gray scale values G2 has the same number of gray scale values as that of the first group of gray scale values G1. As shown in the embodiment of FIG. 5, both of the first and the second group of gray scale values have 256 gray scales. The highest gray scale value (for example, 254) in the second group of gray scale values G2 is smaller than the highest gray scale value (for example, 255) in the first group of gray scale values G1.

The converting process within the gray scale converter 51 is done by referring on a SOD look-up table 511 which is built within the gray scale converter 51. As illustrated in the FIG. 5, the SOD look-up table 511 is used to sequentially sort out and line up each of the gray scale values in the first group of gray scale values G1 and second group of gray scale values G2. And the SOD look-up table 511 matches up each of the gray scale values from the both groups in order.

For example, when the video signal 41 needs to display a gray scale having the gray scale value of 244 in a sub-pixel in the current frame. The gray scale value 244 (in implementation, the number will be represented in binary number) is converted to the gray scale value 243 (which also will be represented in binary number in implementation) by looking up the SOD look-up table 511, so as to obtained the corresponding gray scale value for the driving signal 41'.

The control voltage $V_{CL}$ is generated according to the driving signal 41'. The control voltage $V_{CL}$ is limited not to exceed the gray scale value 254 because of the converting process through the gray scale converter 51.

The look-up table unit 46 comprises a gamma correction table 461. The driving signal 41' looks up the gamma correction table 461 for generating a corrected gray scale values of the driving signal 41' in the static state. In addition, the overdrive signal 43 looks up the gamma correction table 461 for generating a corrected gray scale value of the overdrive signal 43 in the dynamic state.

The previously mentioned embodiments of the present invention have shown, the decimal point gray scale (as shown in the embodiment of FIG. 5, in the second group of gray scale values G2, the value of the decimal point gray scale is 0.5) can be used to make the second group of gray scale values G2 having the same number of gray scale values as that of the first group of gray scale values G1. If the decimal point gray scale is not inserted, the number, or the amount, of gray scale values in the second group of gray scale values G2 will be less than that of the first group of gray scale values G1. In that case, the applicable number of gray scale values for driving signal 41' will be less than the video signal 41, and the defect of so called the "lose gray scale" will be formed.

Therefore, the present invention inserts an additional gray scale in between two integer gray scale values and defines it as a "decimal point gray scale". In implementation, the integer gray scale value is represented in binary numbers. It requires 8 bits to represent 256 gray scales for the embodiment with total number of 256 gray scales.

The decimal point gray scale requires at least one extra bit for representing in binary numbers. And one decimal point gray scale uses the extra one bit to inserts in between two neighboring integer gray scale values. Therefore, after the converting process through the gray scale converter 51, the video signal 41, which is represented with 8 bits, is converted to the driving signal 41', which is represented with 9 bits. Typical bit adding usually adds 2 bits at once. Therefore, in one embodiment of the present invention, the video signal 41, which is represented with 8 bits, is converted to the driving signal 41', which is represented with 10 bits.

Figure 8:
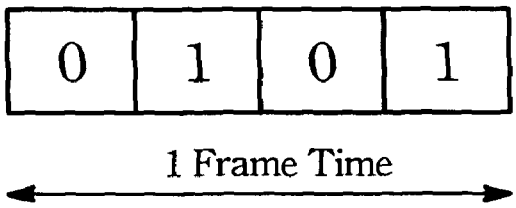
FIG. 8 illustrates an embodiment of a method for generating a decimal point gray scale.

The implementation related to the decimal point gray scale is illustrated as the following. In the embodiment of the FIG. 5, the decimal point gray scale (value 0.5) is added in between two integer gray scale values (values 0 and 1). The frame rate control unit 48 can identify the extra bit(s) of the decimal point gray scale for processing frame rate control. Within one frame time, the frame rate control unit 48 successively switches the gray scale value between the value 0 and the value 1, as shown in the FIG. 8. As a result, the insertion of gray scale (the decimal point gray scale) is able to be practically displayed.

As shown in the embodiment, the decimal point gray scale is inserted in an area of low gray scale. This is because the gamma curve has more linear property at the area of low gray scale. Therefore, it provides better result by inserting decimal point gray scale in the area of low gray scale. In the embodiment with 256 gray scales, the repeating experiments have shown superior performance of the liquid crystal driving system 40 by inserting decimal point gray scale in between two neighboring integer gray scale values within the range of the gray scale value 0 to the gray scale value 32.

One purpose of the present invention is to provide an improvement over the prior art which is incapable of providing overdrive function at the highest gray scale value and the lowest gray scale value. Please continue with the FIG. 5, the driving signal 41' is converted by the gray scale converter 51. And the result shows the highest gray scale value is 254. However, the value of the overdrive signal 43 is selected from the first group of gray scale values G1 and its highest gray scale value can be up to 255. Therefore, even the video signal 41 requires of displaying the highest gray scale value, the present liquid crystal driving system 40 is capable of using the gray scale value 255 for performing the overdrive function.

From the above description, the embodiment of the FIG. 5 is a solution to the prior problem of unable to perform overdrive function at the highest gray scale value. However, the embodiment of the FIG. 5 has not yet illustrated the solution to the problem of unable to perform the overdrive function at the lowest gray scale value.

Figure 6:
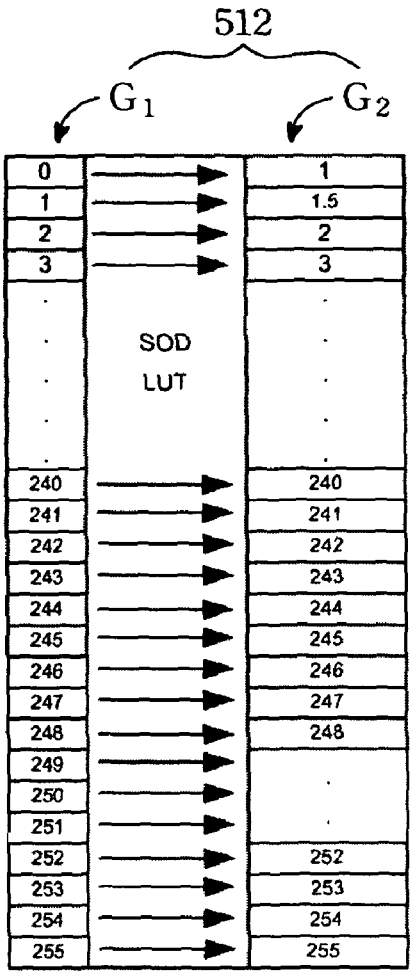
FIG. 6 illustrates a gray scale value look-up table according to another embodiment of the present invention.

One embodiment for solving the problem of unable to perform the overdrive function at the lowest gray scale value is further explained in the FIG. 6 which shows a gray scale look-up table 512. In this embodiment, the lowest gray scale value (value 1) in the second group of gray scale values G2 is larger than the lowest gray scale value (value 0) in the first group of gray scale values G1. Thus, this provides a solution to the problem of unable to perform the overdrive function at the lowest gray scale value. In this embodiment, the solution is done by inserting a decimal point gray scale (value 1.5) in between two integer gray scale values (values 1 and 2), so the second group of gray scale values G2 can have the same number of gray scale values (which totals to 256 gray scales) as that of the first group of gray scale values G1.

Figure 7:
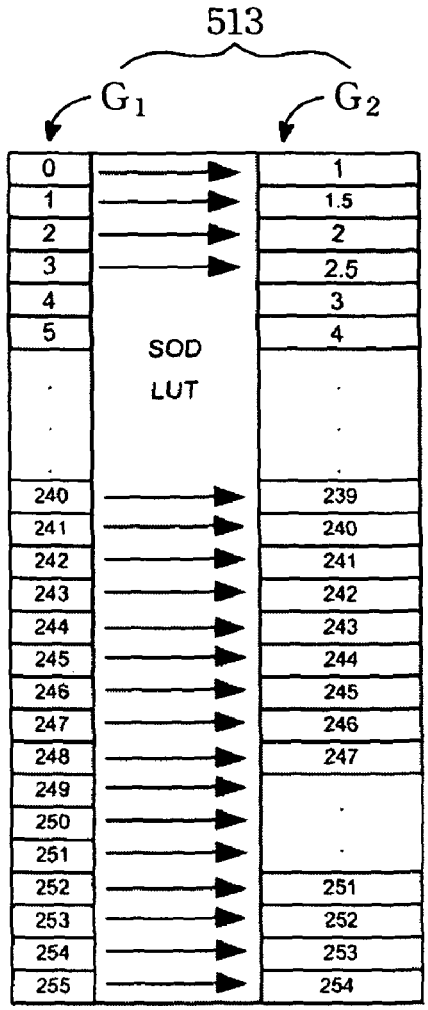
FIG. 7 illustrates a gray scale value look-up table according to further another embodiment of the present invention.

Please refer to the FIG. 7, which illustrates a gray scale look-up table 513 according to another embodiment of the present invention. In this embodiment, the lowest gray scale value (value 1) in the second group of gray scale values G2 is larger than the lowest gray scale value (value 0) in the first group of gray scale values G1; and the highest gray scale value (value 254) in the second group of gray scale values G2 is smaller than the highest gray scale value (255) in the first group of gray scale values G1. The embodiment of the FIG. 7 can allow the liquid crystal driving system 40 to perform the overdrive function in the dynamic state, and can perform the overdrive function when the video signal 41 requests to display at the highest gray scale value or at the lowest gray scale value.

In the embodiment of the FIG. 7, the second group of gray scale values G2 can have the same number of gray scale values (which totals to 256 gray scales) as that of the first group of gray scale values G1 through inserting a decimal point gray scale (value 1.5) between two integer gray scale values (value 1 and 2), and also inserting a decimal point gray scale (value 2.5) between another two integer gray scale values (value 2 and 3).

Based on the above description of the embodiments of the present invention, the following steps are the method for driving liquid crystal display.

a) Receive the video signal 41 from the first group of gray scale values G1.

b) Compare the current frame of the video signal 41 with the previous frame to determine whether the current frame is in the static state or in the dynamic state.

c) When the current frame is determined to be in the static state, convert the video signal 41 to the driving signal 41'. The value of the driving signal 41' is selected from the second group of gray scale values G2 having at lease one decimal point gray scale and having the same number of gray scale values as that of the first group of gray scale values G1. Through the selector 49 to transmit the driving signal 41' to the look-up table unit 46. And to generate the corrective gray scale value of the driving signal 41'.

d) When the current frame is determined to be in the dynamic state, calculate the overdrive signal 43. The value of the overdrive signal 43 is selected from the first group of gray scale values G1. Through the selector 49 to transmit the overdrive signal 43 to the look-up table unit 46. And to generate the corrective gray scale value of the overdrive signal 43.

Besides the above illustrated steps, the mentioned first group of gray scale values G1 and the mentioned second group of gray scale values G2 can fulfill at least one of the following two conditions: 1) The highest gray scale value of the second group of gray scale values G2 is smaller than the highest gray scale value of the first group of gray scale values G1. Or 2) the lowest gray scale value of the second group of gray scale values G2 is larger than the lowest gray scale value of the first group of gray scale values G1. To fulfill both of the two conditions is much more preferable.

The method for driving liquid crystal display and the detail embodiments of the present invention are introduced in the previously mentioned illustrations.

In conclusion, the present invention provides a liquid crystal driving system and a method for driving a liquid crystal panel capable of performing the new overdrive function. It provides solutions to the prior problem of not able to perform the overdrive function at the highest gray scale value and at the lowest gray scale value. The present invention also resolves the prior drawback of gray scale lost. Thus, the present invention achieves a remarkable improvement for the overdrive (TFT overdrive) technology of a current time, also being helpful to the whole liquid crystal display industry.

With the example and explanations above, the features and spirits of the invention are hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A liquid crystal driving system for processing a video signal, the value of the video signal being selected from a first group of gray scale values having a plurality of integer gray scale values, the liquid crystal driving system comprising:

an overdrive unit for comparing a current frame of the video signal with a previous frame to determine in a dynamic state or in a static state, and for calculating an overdrive signal for the dynamic state, wherein the value of the overdrive signal is selected from the first group of gray scale values;

a gray scale converter, electrically connected to the overdrive unit, for receiving the video signal from the overdrive unit and converting to a driving signal, wherein the value of the driving signal is selected from a second group of gray scale values having at least one decimal point gray scale and having the same number of gray scale values as that of the first group of gray scale values, wherein the lowest gray scale value in the second group of gray scale values is larger than the lowest gray scale value in the first gray group of gray scale values; and a look-up table unit, including a gamma correction table, for generating a corrective gray scale value of the driving signal through the gamma correction table in the static state and for generating a corrective gray scale value of the overdrive signal through the gamma correction table in the dynamic state.

2. The liquid crystal driving system of claim 1, wherein the highest gray scale value in the second group of gray scale values is smaller than the highest gray scale value in the first group of gray scale values.

3. The liquid crystal driving system of claim 1, further comprising a selector electrically connected to the overdrive unit, the gray scale converter and the look-up table unit.

4. The liquid crystal driving system of claim 3, wherein the selector is adapted to receive a logic zero signal from the overdrive unit for transmitting the driving signal to the look-up table unit.

5. The liquid crystal driving system of claim 3, wherein the selector is adapted to receive a logic one signal from the overdrive unit for transmitting the overdrive signal to the look-up table unit.

6. The liquid crystal driving system of claim 1, further comprising a frame rate control unit electrically connected to the look-up table unit.

7. The liquid crystal driving system of claim 6, wherein the frame rate control unit is adapted to generate the decimal point gray scale by switching two integer gray scale values neighboring the decimal point gray scale.

8. The liquid crystal driving system of claim 1, wherein the overdrive unit comprises a memory for temporarily storing the previous frame.

9. The liquid crystal driving system of claim 1, wherein the overdrive unit comprises an overdrive signal look-up table.

10. The liquid crystal driving system of claim 1, wherein each gray scale value of the second group of gray scale values has at least one extra bit, and the at least one decimal point gray scale is inserted between two neighboring integer gray scale values through the at least one extra bit.

11. A method for driving a liquid crystal display, comprising:

receiving a video signal from a first group of gray scale values;

comparing a current frame of the video signal with a previous frame to determine whether the current frame is in a static state or in a dynamic state;

when the current frame is determined to be in the static state, converting the video signal to a driving signal, wherein the value of the driving signal is selected from a second group of gray scale values having at least one decimal point gray scale and having the same number of gray scale values as that of the first group of gray scale values, transmitting the driving signal to a look-up table unit, and generating a corrective gray scale value of the driving signal, wherein the lowest gray scale value of the second group of gray scale values is larger than the lowest gray scale value of the first group of gray scale values;

when the current frame is determined to be in the dynamic state, calculating a overdrive signal, the value of the overdrive signal being selected from the first group of gray scale values, transmitting the overdrive signal to a look-up table unit, and generating a corrective gray scale value of the overdrive signal.

12. The method of claim 11, wherein the highest gray scale value in the second group of gray scale values is smaller than that of the first group of gray scale values.

13. The method of claim 11, further comprising switching two integer gray scale values neighboring the decimal point gray scale to generate the decimal point gray scale through a frame rate control unit.

14. The method of claim 11, wherein the calculation of the overdrive signal comprises referring to an overdrive signal look-up table.

15. The method of claim 11, wherein the generation of the corrective gray scale value of the overdrive signal comprises referring to a gamma correction table.

16. The method of claim 11, wherein the generation of the corrective gray scale value of the driving signal comprises referring to a gamma correction table.

17. A liquid crystal driving system for processing a video signal, the value of the video signal being selected from a first group of gray scale values having a plurality of integer gray scale values, the liquid crystal driving system comprising:

an overdrive unit for comparing a current frame of the video signal with a previous frame to determine in a dynamic state or in a static state, and for calculating an overdrive signal for the dynamic state, wherein the value of the overdrive signal is selected from the first group of gray scale values;

a gray scale converter, electrically connected to the overdrive unit, for receiving the video signal from the overdrive unit and converting to a driving signal, wherein the value of the driving signal is selected from a second group of gray scale values having at least one decimal point gray scale and having the same number of gray scale values as that of the first group of gray scale values, wherein the gray scale converter includes a look-up table applied to sequentially sort out and match up each of the gray scale values in the first group of gray scale values and the second group of gray scale values, wherein the lowest gray scale value of the second group of gray scale values is larger than the lowest gray scale value of the first group of gray scale values; and a look-up table unit, including a gamma correction table, for generating a corrective gray scale value of the driving signal through the gamma correction table in the static state and for generating a corrective gray scale value of the overdrive signal through the gamma correction table in the dynamic state.

18. A method for driving a liquid crystal display, comprising:

receiving a video signal from a first group of gray scale values;

comparing a current frame of the video signal with a previous frame to determine whether the current frame is in a static state or in a dynamic state;

when the current frame is determined to be in the static state, referring to a look-up table to find a driving signal corresponding to the video signal, wherein the value of the driving signal is selected from a second group of gray scale values having at least one decimal point gray scale and having the same number of gray scale values as that of the first group of gray scale values, transmitting the driving signal to a look-up table unit, and generating a corrective gray scale value of the driving signal, wherein the lowest gray scale value of the second group of gray scale values is larger than the lowest gray scale value of the first group of gray scale values; and when the current frame is determined to be in the dynamic state, calculating an overdrive signal, the value of the overdrive signal being selected from the first group of gray scale values, transmitting the overdrive signal to a look-up table unit, and generating a corrective gray scale value of the overdrive signal.

* * * * *